US007769327B2

(12) United States Patent
Morimoto et al.

(10) Patent No.: US 7,769,327 B2
(45) Date of Patent: Aug. 3, 2010

(54) DEVELOPING DEVICE AND IMAGE FORMING APPARATUS HAVING A DEVELOPING ROLLER WITH A GROOVED SLEEVE

(75) Inventors: Kiyofumi Morimoto, Tenri (JP); Kohichi Takenouchi, Tenri (JP); Mitsuru Tokuyama, Kizugawa (JP); Hiroo Naoi, Nara (JP); Kazuma Hinoue, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 133 days.

(21) Appl. No.: 12/165,852

(22) Filed: Jul. 1, 2008

(65) Prior Publication Data

US 2009/0010683 A1 Jan. 8, 2009

(30) Foreign Application Priority Data

Jul. 3, 2007 (JP) ..... 2007-175315

(51) Int. Cl.
*G03G 15/09* (2006.01)

(52) U.S. Cl. ..... 399/276; 399/267; 399/277; 430/111.3

(58) Field of Classification Search ..... 399/274, 399/275, 276, 277, 267; 430/110.4, 111.3, 430/111.32, 122.1
See application file for complete search history.

(56) References Cited

U.S. PATENT DOCUMENTS

| | | | | | |
|---|---|---|---|---|---|
| 4,233,935 | A * | 11/1980 | Uehara et al. | 399/274 |
| 4,297,970 | A * | 11/1981 | Tajima et al. | 399/275 X |
| 5,338,894 | A * | 8/1994 | Uchiyama et al. | 399/274 X |
| 5,602,630 | A * | 2/1997 | Endo et al. | 399/271 |
| 6,021,295 | A * | 2/2000 | Ochiai et al. | 399/275 |
| 2001/0048827 | A1* | 12/2001 | Okada | 399/276 |
| 2006/0024092 | A1 | 2/2006 | Mizobe | 399/272 |
| 2008/0240795 | A1 | 10/2008 | Mizobe | 399/277 |
| 2008/0247786 | A1* | 10/2008 | Nakayama et al. | 399/274 |

FOREIGN PATENT DOCUMENTS

| | | | |
|---|---|---|---|
| JP | 2004-170555 | | 6/2004 |
| JP | 2005-24682 | A | 1/2005 |
| JP | 2006-65317 | A | 3/2006 |
| JP | 2006-099029 | | 4/2006 |
| JP | 2006-099029 | A * | 4/2006 |
| JP | 2006-184475 | A | 7/2006 |
| JP | 2007-025463 | A | 2/2007 |
| JP | 2007-079117 | | 3/2007 |

* cited by examiner

*Primary Examiner*—Sophia S Chen
(74) *Attorney, Agent, or Firm*—Nixon and Vanderhye, PC

(57) ABSTRACT

A developing device includes a developing roller and a blade. The developing roller includes: a developing sleeve which rotates while holding two-component developer composed of toner and magnetic carrier on the outer surface having a plurality of grooves extending in parallel to an axis of the rotation; and a magnetic member, provided inside the developing sleeve in such a manner as to be unrotatable, for attracting the two-component developer onto the outer surface of the developing sleeve. The blade is provided outside the rotating sleeve with a gap from the outer surface of the developing sleeve for scraping off a part of the two-component developer on the outer surface of the developing sleeve. Also, the magnetic member includes a magnet for controlling magnetic flux density in the gap to range from 70 mT to 150 mT. This allows preventing image degradation caused by generation of development memory.

11 Claims, 6 Drawing Sheets

DEVELOPING DEVICE AND IMAGE FORMING APPARATUS HAVING A DEVELOPING ROLLER WITH A GROOVED SLEEVE

This Nonprovisional application claims priority under 35 U.S.C. §119(a) on Patent Application No. 175315/2007 filed in Japan on Jul. 3, 2007, the entire contents of which are hereby incorporated by reference.

FIELD OF THE TECHNOLOGY

The present technology relates to a developing device included in an electrophotographic image forming apparatus.

BACKGROUND OF THE TECHNOLOGY

In electrophotographic image forming apparatuses such as a multifunction printer, a copying machine, a printer, and a facsimile, a developing process is carried out by providing developer to a latent image formed on a surface of a photoreceptor. Various methods are available as a developing process. Among them, a magnetic brush developing method by using two-component developer composed of toner and magnetic carrier has been widely used because it is excellent in high-speed capability. Note that two-component developer is merely called developer and magnetic carrier is called carrier hereinafter.

A developing device in a magnetic brush developing method includes a developer tank and a magnetic developing roller, as illustrated in FIG. 1 in the following Patent Citation 1. The developing roller magnetically attracts (scoops) developer stored inside the developer tank, and holds the developer on an external surface of the developing roller, and then conveys the developer to a photoreceptor. This procedure achieves the developing process.

Recently, minimization of the particle size in toner and carrier, both of which are contained in developer, is positively carried out to improve image quality. However, as particle sizes of toner and carrier are minimized, flowability of developer drops, resulting in a problem such as decline in image density because the developing roller fails to attract enough developer from the developer tank. An example of a technique to solve this problem is a developing device in the Patent Citation 1. In the Patent Citation 1, a developing device includes a developing roller composed of: a developing sleeve (axis sleeve) with a plurality of grooves on an outer surface that extend in a direction of a rotation axis; and a magnet roller inserted in a hollow inside the developing sleeve, and the distance between the grooves and the depth of each groove are set to be within predetermined ranges, in order to improve the attracting effect (scooping effect) of developer by the developing roller.

[Patent Citation 1] Japanese Unexamined Patent Publication, Tokukai 2004-170555 (date of publication: Jun. 17, 2004)

However, in a developing device, which includes a developing sleeve having a plurality of grooves on the outer surface, the following adverse effect was found. After printing an image partially having an area with extremely high density, another image printed at a given density partially has an area with lower density than the given density.

The following explains this adverse effect. In a magnetic brush developing method, normally, a bias is applied to a developing roller during a developing process. This allows a potential of developer on the external surface of the developing sleeve to be substantially uniform.

When there is performed first printing in which an image partially having an area with extremely high density (central part in the main scanning direction in FIG. 1 (*a*)) is printed as shown by reference number 300 in FIG. 1(*a*) and then the developing device is driven, an electric potential difference of developer is generated on the outer surface of the developing sleeve 200 between (i) area "α" which is a central part in the main scanning direction (corresponding to the area with extremely high density in the first printing) and (ii) area "b" which is a part other than the area "α", as illustrated in FIG. 1(*b*). Specifically, an electric potential of developer on the area "α" corresponding to the area with extremely high density in the first printing is lower than that of the developer on the area "b". Note that such phenomenon of potential differences is called "development memory" in this specification.

Assume that after the development memory illustrated in FIG. 1(*b*) is generated on the developing sleeve 200 by carrying out the first printing, for example, there is performed second printing in which a solid image having substantially uniform density. In this case, the potential of developer on the area "α" is lower than the potential of developer on the area "b". Therefore, in a photosensitive drum, a potential of a part having toner provided from the area "α" is lower than that of a part having toner provided from the area "b". As a result, in an image transferred on a sheet, an area printed with the toner provided from the area "α" has lower density than the area printed with the toner provided from the area "b". Namely, in the case of printing a solid image having substantially uniform density by the developing sleeve 200 in which the development memory is generated as illustrated in FIG. 1 (*b*), a central part in the main scanning direction has lower density than areas on both sides of the central part, as shown by a reference number 400 in FIG. 1 (*a*).

As explained above, in the case where an image partially having an area with extremely high density is printed, the development memory is generated in the developing sleeve. Thereafter, when an image is printed at a given density, the image partially has an area with lower density than the given density due to the development memory. Therefore, it is apparent that unless the generation of the development memory is prevented, density unevenness is generated, resulting in the degradation of the printed image.

SUMMARY OF THE TECHNOLOGY

The objective of the present technology is to prevent the degradation of a printed image caused by the generation of the development memory in a developing device including a developing roller with a rotating sleeve.

The inventors have studied how to prevent the development memory generated in a rotating sleeve included in a developing device. As a result of diligent studies, the inventors found out that the generation of the development memory at the developing sleeve can be prevented by the developing device including: a developing roller including a rotating sleeve which rotates while holding two-component developer composed of toner and magnetic carrier on an outer surface having a plurality of grooves that extend in a direction parallel to an axis of the rotation, and a magnetic member, provided inside the rotating sleeve in such a manner as to be unrotatable, for attracting the two-component developer onto the outer surface of the rotating sleeve; and a blade provided outside the rotating sleeve with a gap from the outer surface of the rotating sleeve for scraping off a part of the two-component developer, the magnetic member including a magnet for controlling a magnetic flux density in the gap to range from 70 mT to 150 mT.

Accordingly, this developing device has an effect of suppressing degradation in a printed image caused by the generation of the development memory.

Additional objectives, features, and strengths of the technology will be made clear by the description below. Further, the advantages will be evident from the following explanation in reference to the drawings.

BRIEF DESCRIPTION OF THE DRAWINGS

FIG. 1 (*b*) is a drawing illustrating a developing sleeve in which the development memory is generated

FIG. 7 (*b*) is an explanatory drawing illustrating a magnetic brush adhered onto the toner film formed on the entire outer surface of the developing sleeve.

FIG. 7 (*c*) is an explanatory drawing illustrating that a part of the toner film is detached from the outer surface of the developing sleeve.

FIG. 7 (*d*) is an explanatory drawing illustrating that magnetic brush adheres onto the toner film and the outer surface of the developing sleeve in a case where a part of the toner film is detached from the outer surface of the developing sleeve.

FIG. 8 (*b*) is an explanatory drawing illustrating that a part of the developer adhered onto the outer surface of the developing sleeve is scraped off by a doctor blade in a conventional developing device.

DESCRIPTION OF THE EMBODIMENTS

Structure of Image Forming Apparatus

Figure 1A:
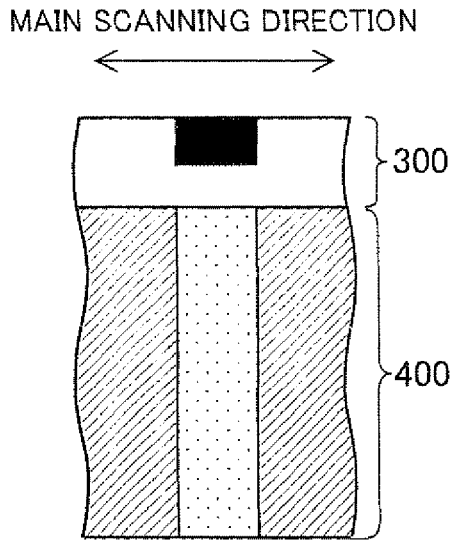
FIG. 1 (*a*) is a drawing schematically illustrating an image test-printed by an image forming apparatus.
Figure 1B:
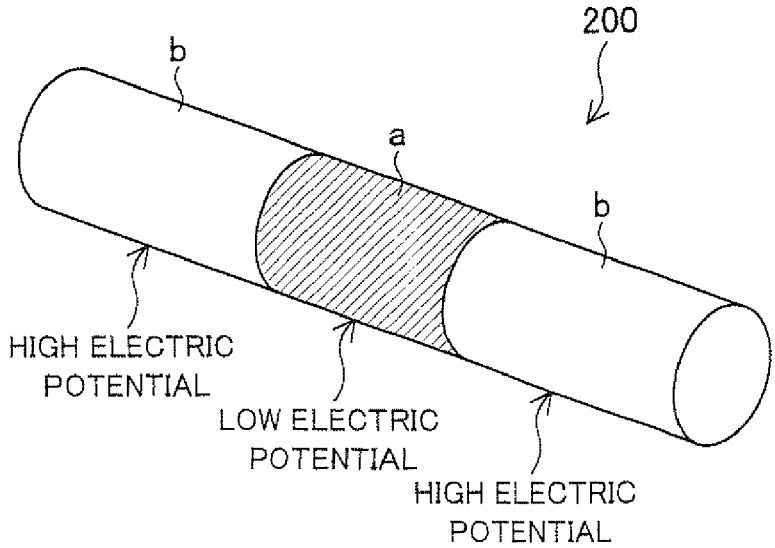
Figure 2:
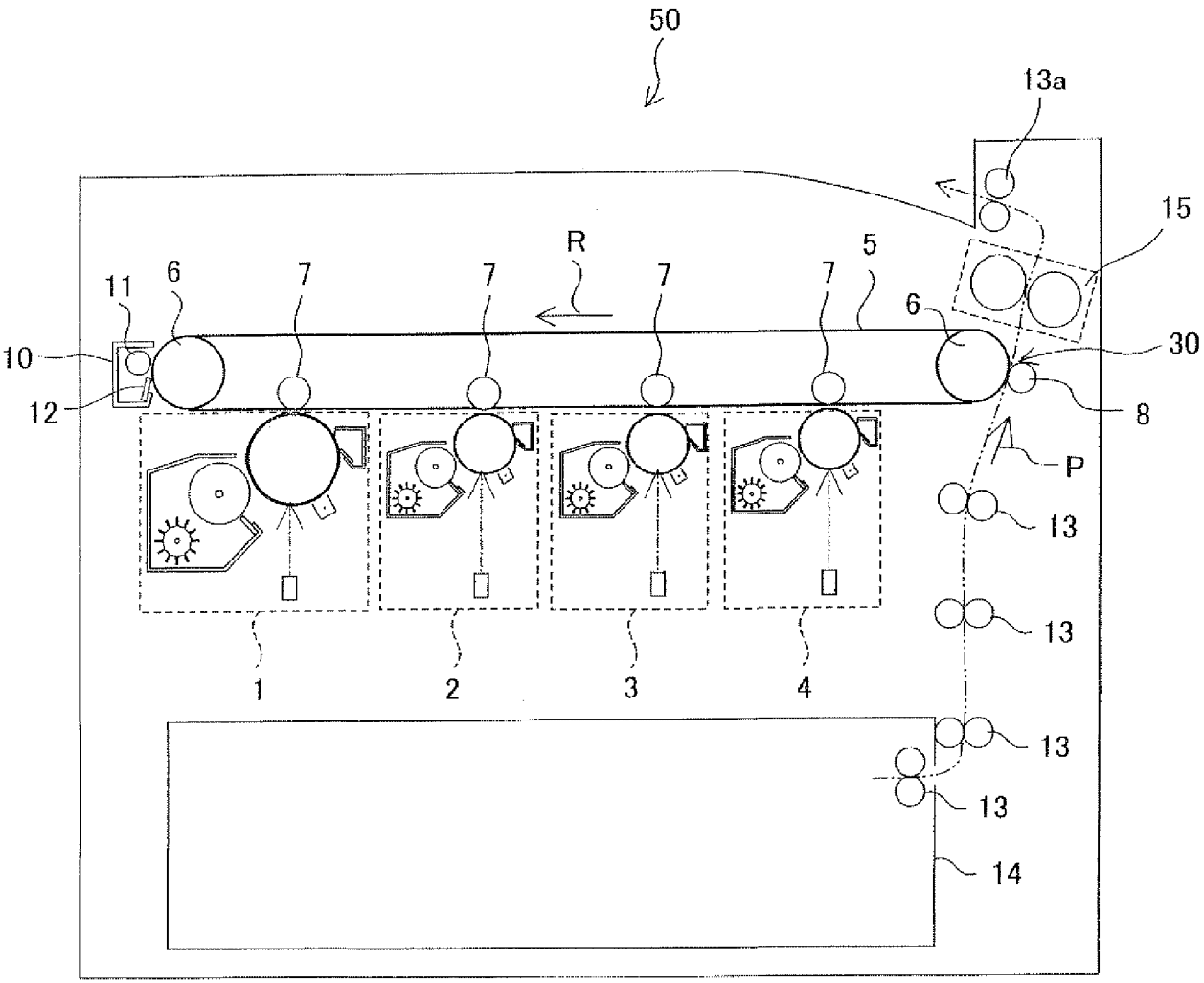
FIG. 2 is a drawing illustrating an internal structure of an image forming apparatus in accordance with an embodiment of this technology.

The following explains an embodiment of this technology with reference to FIG. 2 through FIG. 8. FIG. 2 is a schematic view illustrating an internal structure of an image forming apparatus. As illustrated in FIG. 2, an image forming apparatus 50 is a tandem engine color printer including a black image forming unit 1 for forming a black toner image, a cyan image forming unit 2 for forming a cyan toner image, a magenta image forming unit 3 for forming a magenta toner image, a yellow image forming unit 4 for forming a yellow toner image.

Above these four image forming units 1 through 4, an intermediate transfer belt (endless belt) 5 is provided. The intermediate transfer belt 5 is suspended by two supporting rollers 6 and rotates in a direction indicated by an arrow R. As a material of the intermediate transfer belt 5, resins such as polyimide, polyamide, and the like, mixed with an appropriate amount of a conductive material may be used.

Outside the intermediate transfer belt 5, the black image forming unit 1, the cyan image forming unit 2, the magenta image forming unit 3, and the yellow image forming unit 4 are arranged in this order from the upstream to the downstream of the rotation direction R.

Inside the intermediate transfer belt 5, a plurality of first transfer rollers 7 for transferring single-color toner images formed in the image forming units 1 through 4 to the intermediate transfer belt 5 are provided so as to face the image forming units 1 through 4, respectively. Single-color toner images formed in the image forming units 1 through 4 are transferred to the intermediate transfer belt 5 so that the single-color toner images overlap one another. This allows forming a multi-color image.

Also, outside the intermediate transfer belt 5, a second transfer roller 8 for transferring the multi-color image formed on the intermediate transfer belt 5 to a sheet of paper (paper medium) is provided at downstream of the yellow image forming unit 4 with regard to the rotation direction R.

Further, outside the intermediate transfer belt 5, a belt cleaning unit 10 for cleaning the surface of the intermediate transfer belt 5 is provided at downstream of the second transfer roller 8 with regard to the rotation direction R. The belt cleaning unit 10 includes: a belt cleaning brush 11, which is provided to contact the intermediate transfer belt 5; and a belt cleaning blade 12, which is located at downstream of the belt cleaning brush 11 with regard to the rotation direction R.

Further, below the image forming units 1 through 4, a tray 14 for storing paper is provided. A sheet of paper in the tray 14 is fed by a plurality of feeding rollers 13 to a second transfer zone 30 in which the second transfer roller 8 and the intermediate transfer belt 5 face each other. Note that the direction indicated by an arrow P in FIG. 2 is a direction in which a sheet is fed.

Further, at the downstream of the second transfer roller 8 with regard to the paper feeding direction P, a fixing unit 15 is provided for fixing the transferred image onto a sheet of paper. Also, at further downstream of the fixing unit 15 with regard to the paper feeding direction P, ejection rollers 13*a* are provided for outputting a sheet on which the image is fixed from the image forming apparatus 50.

In the image forming apparatus 50, the image forming units 1 through 4 transfer single-color toner images, respectively, to the intermediate transfer belt 5 so that a multi-color image is formed on the intermediate transfer belt 5. Then, the multi-color image on the intermediate transfer belt 5 is secondary transferred at the second transfer zone 30 to a sheet of paper fed by the feeding rollers 13, and then the transferred image is fixed onto the paper at the fixing unit 15. Thereafter, the paper on which the multi-color image is fixed is outputted from the image forming apparatus 50 by the ejection rollers 13*a*. On the other hand, residual toner remaining on the intermediate transfer belt 5 which was not transferred to the paper, is cleaned by the belt cleaning unit 10.

[Structure of the Image Forming Unit]

Figure 3:
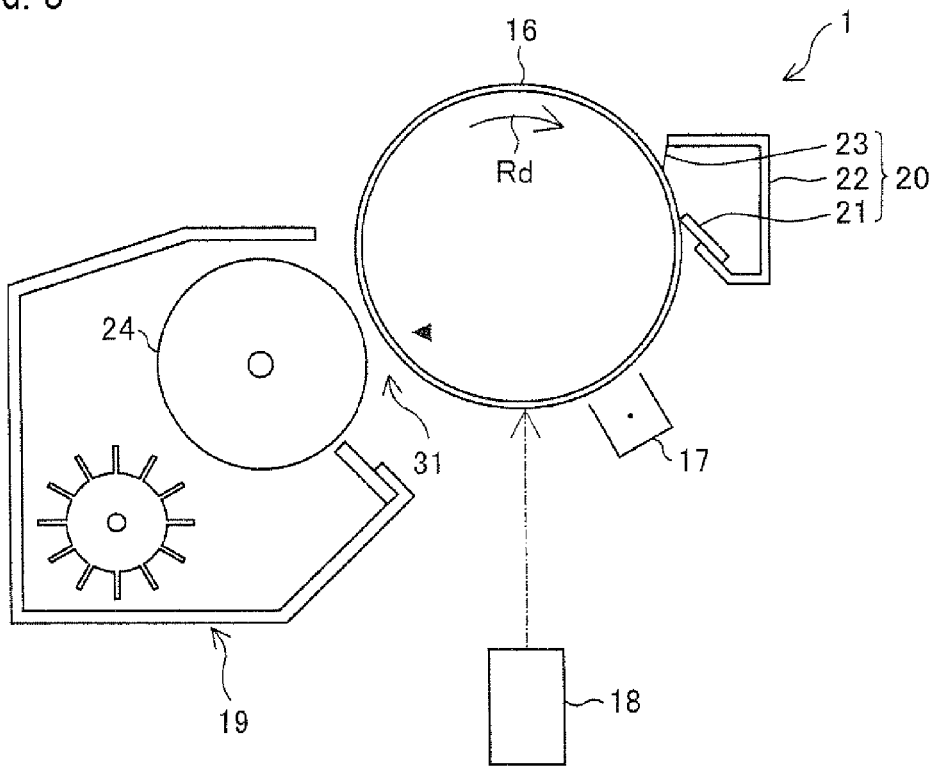
FIG. 3 is a drawing illustrating a detailed structure of the black image forming unit illustrated in FIG. 2.

The following explains structures of the image forming units 1 through 4 in detail. FIG. 3 illustrates a detailed structure of the black image forming unit 1 illustrated in FIG. 2. Note that the cyan image forming unit 2, the magenta image forming unit 3, and the yellow image forming unit 4 are substantially equal to the black image forming unit 1 except for a toner color which each image forming unit deals with. Therefore, the following explains only a structure of the black image forming unit 1 and explanations of the structures of the cyan image forming unit 2, the magenta image forming unit 3, and the yellow image forming unit 4 are omitted here.

As illustrated in FIG. 3, the black image forming unit 1 includes: a photosensitive drum 16; a charging unit 17 at a periphery of the photosensitive drum 16 for charging same; an exposure unit 18 for writing an electrostatic latent image on an outer surface of the photosensitive drum 16; a developing device 19 for visualizing (developing) the electrostatic latent image written on the outer surface of the photosensitive drum 16; and a photosensitive drum cleaner 20 for cleaning residue such as residual toner remaining on the outer surface of the photosensitive drum 16 after the first transfer.

The photosensitive drum 16 includes a metal drum made of aluminum and the like as a base, and a photoconductive layer made of organic photoconductor (OPC), amorphous silicon (a-Si), and the like which is a thin film formed on the outer surface of the metal drum.

The charging unit 17 is a scorotron charging unit which charges the outer surface of the photosensitive drum 16 to have a certain potential via corona discharge. Note that the charging unit 17 is not limited to a scorotron charging unit and may be a contact charging unit including a charging roller or a charging brush.

The exposure unit 18 is a laser scanning unit (LSU) which exposes the outer surface of the photosensitive drum 16 by emitting laser light in response to an image signal, and changes a surface potential of the photosensitive drum 16 charged by the charger 17, thereby forming an electrostatic latent image on the outer surface of the photosensitive drum 16 in accordance with image information. Note that the exposure unit 18 is not limited to a laser scanning unit and may be a light emitting diode (LED) array.

The developing device 19 stores two-component developer (called "developer" hereinafter) composed of toner and magnetic carrier (called "carrier" hereinafter) and develops an electrostatic latent image formed on the photosensitive drum 16 by using the toner contained in the two-component developer. A structure of the developing device 19 is detailed later.

The photosensitive drum cleaner 20 includes a cleaning blade 21, a cleaner housing 22, and a seal 23.

The cleaning blade 21 is provided on the outer surface of the photosensitive drum 16 in such a manner that the cleaning blade 21 and the outer surface of the photosensitive drum 16 press against each other in order to clean residue remaining on the outer surface of the photosensitive drum 16. As illustrated in FIG. 3, the cleaning blade 21 is provided to press against the outer surface of the photosensitive drum 16 in such a manner as to make an acute angle between the cleaning blade 21 and the photosensitive drum 16 at the downstream of the cleaning blade 21 (i.e. at the downstream of the rotation direction Rd of the photosensitive drum 16).

The cleaner housing 22 is for storing the residue scraped off by the cleaning blade 21. Note that the cleaning blade 21 is mounted in the cleaner housing 22.

The seal 23 is for sealing up inside the cleaner housing 22. One end of the seal 23 is fixed with the cleaner housing 22 at the upstream of the cleaning blade with regard to the rotation direction Rd of the photosensitive drum 16, and the other end of the seal 23 is in contact with the photosensitive drum 16.

[Structure of a Developing Device]

Figure 4:
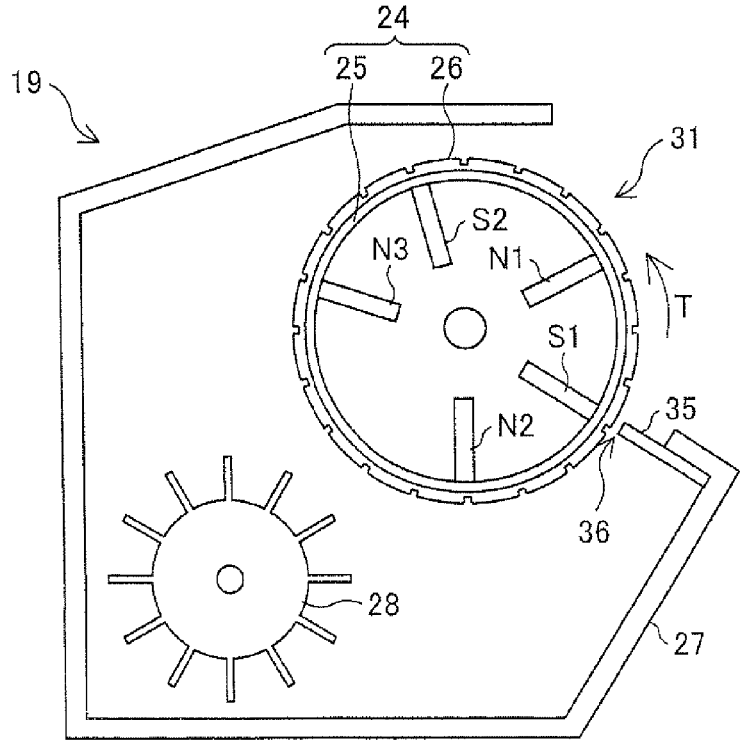
FIG. 4 is a drawing illustrating a detailed structure of the developing device illustrated in FIG. 3.

The following explains a structure of the developing device 19 in detail. FIG. 4 is a schematic view of the developing device 19 illustrated in FIG. 3.

As illustrated in FIG. 4, the developing device 19 includes: a developer tank 27 for storing developer; a developing roller 24 on which a developing bias is applied and which supplies developer to the photosensitive drum 16; a doctor blade (blade) 35 for controlling thickness of a developer layer by scraping off extra developer adhered onto the external surface of the developing sleeve 26; and a stirring and carrying member 28 for stirring developer inside the developer tank 27 and carrying the developer to the developing roller 24.

The developing roller 24 is provided at an opening section 31 of the developer tank 27 in such a manner as to face the photosensitive drum 16 with a gap between the developing roller 24 and the photosensitive drum 16 (see FIG. 3), and attracts developer stored inside the developer tank 27 to the outer surface thereof and holds the attracted developer there. Thereafter, the developing roller 24 rotates to carry and supply the attracted developer to the outer surface of the photosensitive drum 16. Namely, the developing roller 24 scoops up the developer inside the developer tank 27 to the outer surface of the photosensitive drum 16.

The developing roller 24 includes a magnet roller (magnetic member) 25 with a cylindrical shape and a developing sleeve (rotating sleeve) 26, which is provided to surround the outer surface of the magnet roller 25 and to be rotatable in a direction of an arrow T (counterclockwise direction).

The magnet roller 25 is a hollow and cylindrical magnetizing member, which is provided inside the developing sleeve 26 in such a manner as to be unrotatable by fixing ends of the magnet roller 25 in an axis direction to side walls of the developer tank 27, respectively. Also, on an internal surface of the magnet roller 25, a plurality of magnets are provided in the circumferential direction with a distance between each other. The magnet roller 25 is magnetized by these magnets.

In a structure example illustrated in FIG. 4, the magnet roller 25 includes magnets N1, N2, and N3 which form the north pole of the magnet roller 25, and magnets S1 and S2 which form the south pole of the magnet roller 25.

The magnets N1, N2, N3, S1, and S2 are provided in such a manner that one end of each magnet is in contact with the internal surface of the magnet roller 25, and the other end of each magnet is away from the internal surface of the magnet roller 25. The north pole of the magnets N1, N2, and N3 are in contact with the internal surface of the magnet roller 25, and the south pole of the magnets S1 and S2 are in contact with the internal surface of the magnet roller 25.

The magnet N1 is provided between the central axis of the photosensitive drum 16 and the central axis of the magnet roller 25, and the magnetic flux density is set to be 110 mT (milli Tesla) on peak.

The magnet N2 is provided at the position rotating by 117 degrees from the position of the N1 magnet in a direction opposite to the direction indicated by T, and the magnetic flux density is set to be 56 mT on peak.

The magnet N3 is provided at the position rotating by 224 degrees from the position of the N1 magnet in the direction opposite to the direction indicated by T, and the magnetic flux density is set to be 42 mT on peak.

The magnet S2 is provided at the position rotating by 282 degrees from the position of the N1 magnet in the direction opposite to the direction indicated by T, and the magnetic flux density is set to be 80 mT on peak.

The magnet S1 is provided at the position that allows the magnetism of the magnet S1 to affect a gap 36 between the outer surface of the developing sleeve 26 and the edge of the doctor blade 35, and the magnetic flux density is set to be 85 mT on peak. Specifically, the magnet S1 is provided between the rotation axis of the developing sleeve 26 and the edge of the doctor blade 35, at the position rotating by 59 degrees from the position of the N1 magnet in the direction opposite to the direction indicated by T.

Note that the peak value of the magnetic flux density of a magnet means a magnetic flux density measured at the point closest to the magnet on the outer surface of the developing sleeve 26. In the developing device 19 of the present embodiment, the point closest to the magnet S1 on the outer surface of the developing sleeve 26 is the gap 36. Therefore, the peak value of the magnetic flux density at the gap 36 is 85 mT.

Figure 5:
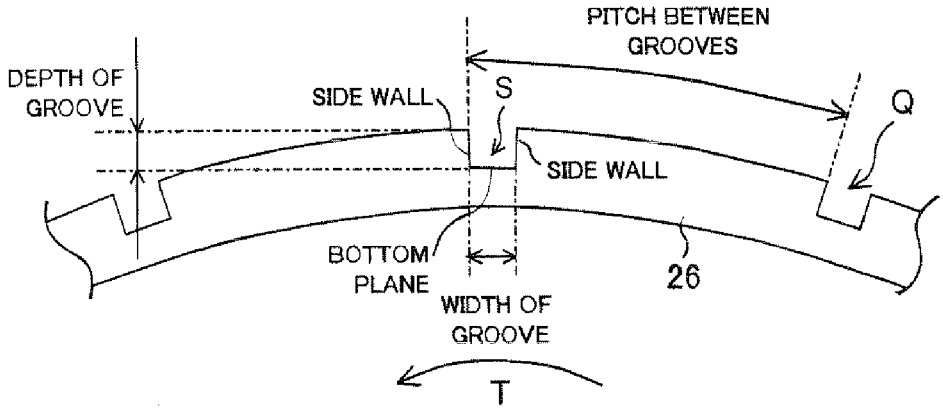
FIG. 5 is a detailed cross-section view illustrating the developing sleeve illustrated in FIG. 4.

As illustrated in FIG. 4 and FIG. 5, the developing sleeve 26 includes a plurality of grooves on its outer surface which extend parallel to the rotation axis direction of the developing sleeve 26, and is an axis blade made of non-magnetic material.

The doctor blade 35 is provided outside the developing sleeve 26 in such a manner as to leave the gap 36 from the outer surface of the developing sleeve 26. The gap 36 between the edge of the doctor blade 35 and the outer surface of the developing sleeve 26 is set to be 0.3 mm to 1 mm.

With the developing device 19 in FIG. 4 as described above, developer stored inside the developer tank 27 is magnetically attracted and is adhered onto the outer surface of the developing sleeve 26 by the magnetism generated by the magnet N2 inside the magnet roller 25. Thereafter, the developer adhered onto the outer surface of the developing sleeve 26 is carried to the outer surface of the photosensitive drum 16 through the gap 36 by the rotation of the developing sleeve 26.

When passing through the gap 36, a part of the developer adhered onto the outer surface of the developing sleeve 26 is scraped off by the doctor blade 35 in combination with the magnetic force generated by the magnet S1. This allows thickness of a developer layer adhered onto the outer surface of the developing sleeve 26 to be controlled.

Figure 6:
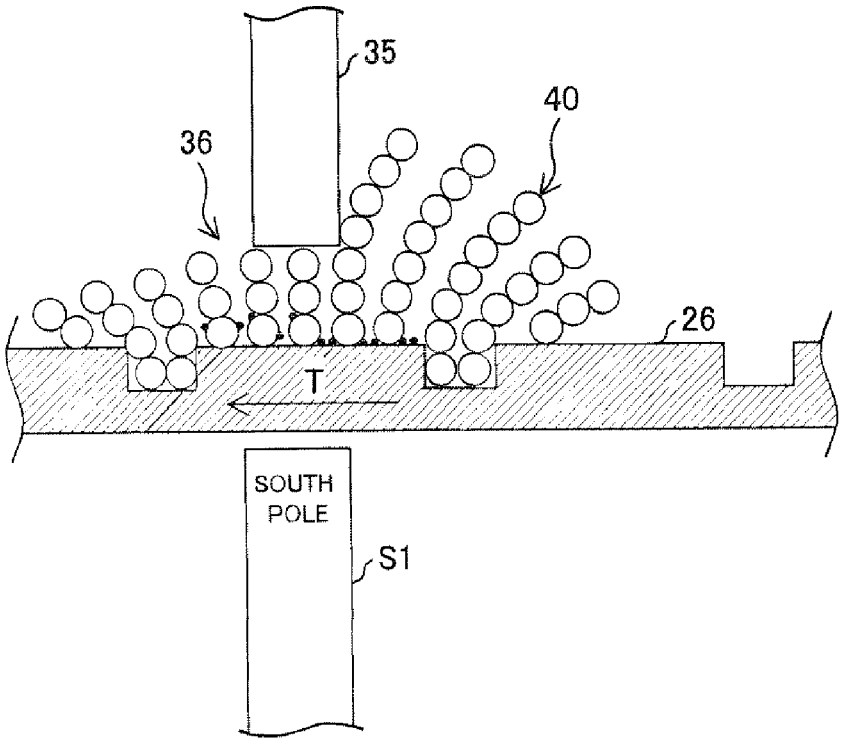
FIG. 6 is an explanatory drawing illustrating a mechanism in which the amount of developer on an outer surface of the developing sleeve is controlled by a doctor blade.
Figure 7A:
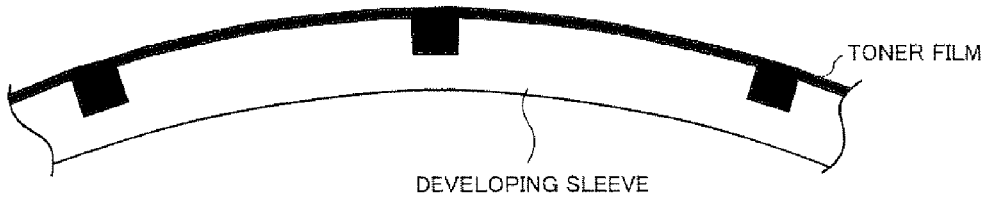
FIG. 7 (*a*) is an explanatory drawing illustrating a toner film formed on an entire outer surface of the developing sleeve.
Figure 7B:
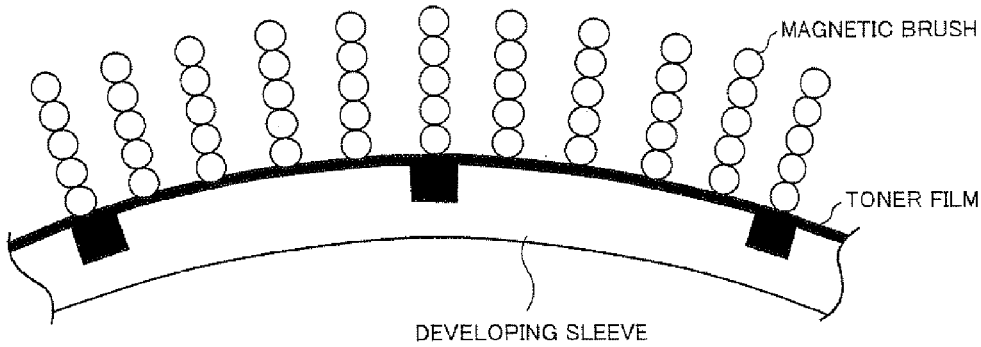
Figure 7C:
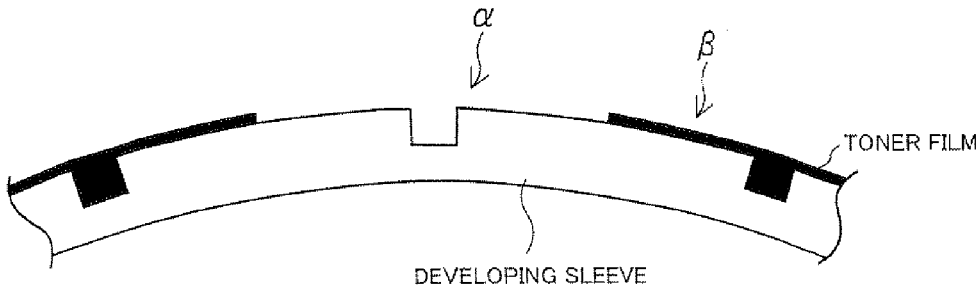
Figure 7D:
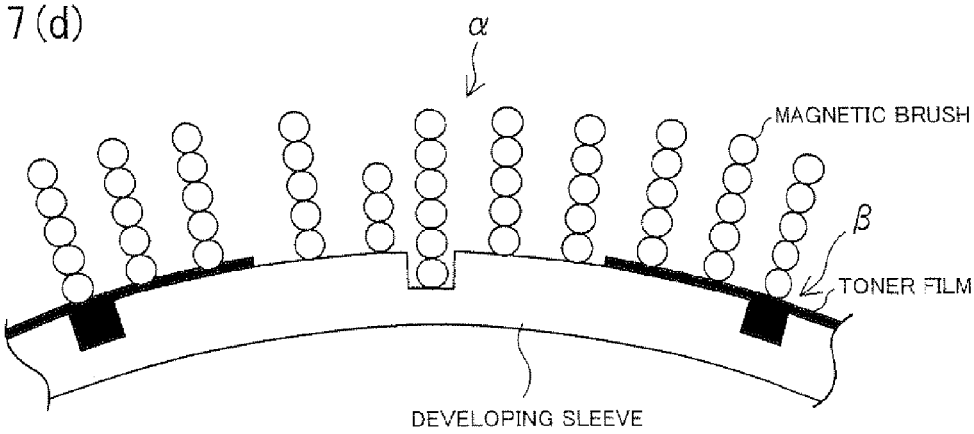

The following explains in detail the mechanism how developer is scraped off by the doctor blade 35 in combination with magnetic force generated by the magnet S1 with reference to FIG. 6. FIG. 6 is an explanatory drawing illustrating the mechanism how the amount of developer adhered onto the outer surface of the developing sleeve 26 is controlled by the doctor blade 35. As illustrated in FIG. 6, in the vicinity of the gap 36 between the outer surface of the developing sleeve 26 and the edge of the doctor blade 35, a magnetic brush 40 made of carrier is formed under the influence of the magnetism of the magnet S1. The magnetic brush 40 is formed in such a manner as to draw lines of magnetic force of the magnet S1 like standing spikes and is magnetically attracted and adhered onto the outer surface of the developing sleeve 26. Also, toner is adhered around the magnetic brush 40.

Thereafter, the magnetic brush 40, which is adhered on the outer surface of the developing sleeve 26, is collided with the doctor blade 35 while going through the gap 36 by the rotation of the developing sleeve 26 (rotation in the direction T), and is broken by the collision impact. As a result, the amount of developer adhered onto the outer surface of the developing sleeve 26 is controlled because a part of the magnetic brush 40 is scraped off by the doctor blade 35 and the amount of developer per unit area is reduced at the downstream of the gap 36 with regard to the direction T compared with the amount of developer per unit area at the upstream of the gap 36.

The above is the explanation of the developing device 19 of the present embodiment. It should be noted that in the developing device 19, the magnetic flux density of the gap 36 between the outer surface of the developing sleeve 26 and the edge of the doctor blade 35 is set to be 85 mT, which is higher than that of a conventional developing device (less than 60 mT in a conventional developing device). This allows the magnetic brush 40 passing through the gap 36 in the developing device 19 to be stiffer than that of a conventional developing device. With the developing device 19 of the present embodiment, it is possible to prevent the development memory which arises a problem in the conventional developing device and a conventional image forming apparatus, because the magnetic brush 40 passing through the gap 36 is stiffer than that of the conventional developing device.

The following explains in detail the reasons the inventors figured out why the development memory is generated, and then the reasons why the developing device 19 of the present embodiment is capable of preventing the development memory.

In a developing device, a toner film having no carrier continues to be adhered onto the entire outer surface of a developing sleeve having a plurality of grooves both in cases where the developing device is in operation and not in operation, as illustrated in FIG. 7 (*a*). When the developing device is driven and the developing sleeve rotates, as illustrated in FIG. 7 (*b*), magnetic brushes made of carrier are adhered onto the toner film which is adhered on to the outer surface of the developing sleeve. Further, toner powder is attached around the magnetic brush, and the attached toner powder is supplied to the photosensitive drum (although omitted in the explanation of the present embodiment and the drawings such as FIG. 6, the toner film continues to be adhered onto the entire outer surface of the developing sleeve 26 in the developing device 19 of the present embodiment both in operation and not in operation).

Also, a developing bias is applied to the developing sleeve while the developing device is in operation, and each of the magnetic brushes illustrated in FIG. 7 (*b*) has a substantially uniform electric potential and all the toner powder attached around the magnetic brushes has a substantially uniform electric potential.

After printing an image partially having an area with extreme high density, however, a toner film falls off from an area "α" on the outer surface of the developing sleeve that corresponds to the area with high density (the area "α" that supplied toner to the area with high density) in the previous printing. Thus, as illustrated in FIG. 7 (*c*), while an area "β" on the outer surface of the developing sleeve, which is other than the area "α" corresponding the area with high density, continues to have a toner film, the area "α" corresponding to the area with high density in the previous printing is exposed.

Thereafter, when the developing sleeve in a state as illustrated in FIG. 7 (*c*) is rotated for a printing process, magnetic brushes are adhered directly onto the outer surface of the developing sleeve in the area "α", whereas magnetic brushes are adhered onto a toner film existing on the outer surface of the developing sleeve, not directly onto the outer surface of the developing sleeve in the area "β".

A developing bias is applied to the developing sleeve while the developing device is in operation. In FIG. 7 (*d*), magnetic brushes are adhered directly onto the outer surface of the developing sleeve in the area "α", whereas magnetic brushes are adhered onto the toner film existing on the outer surface of the developing sleeve, not directly onto the outer surface of the developing sleeve in the area "β". This causes the area "α" and the area "β" to have different electric potentials (The electric potential of the magnetic brush in the area "α" is lower than that in the area "β"). In the toner provided from the developing sleeve to the photosensitive drum, the toner provided from the area "α" has a lower electric potential than that from the area "β". Accordingly, in the photosensitive drum, a part having the toner provided from the area "α" has a lower electric potential than a part having the toner provided from the area "β". As a result, in a toner image transferred from the photosensitive drum to a sheet of paper, a part which is created by the toner provided from the area "α" has lower density than a part which is created by the toner provided from the area "β".

Namely, after printing an image partially having extremely high density, an electric potential difference of developer is generated between the area "α" corresponding to the area printed with high density and the area "β" other than the area "α" in the developing sleeve. This phenomenon is called "development memory". When a solid image with substantially even density is printed with the developing sleeve in which the "development memory" is generated, the printed image has uneven density between a part created by the toner provided from the area "α" and a part created by the toner provided from the area "β". Therefore, it is apparent that quality of the printed image is degraded by uneven density unless the generation of the "development memory" is prevented.

The following explains in detail how the developing device 19 of the present embodiment can prevent the "development memory" and why the conventional developing device is difficult to prevent the "development memory".

As described above, the developing device 19 of the present embodiment is designed in such a manner that the magnetic flux density of the gap 36 between the outer surface of the developing sleeve 26 and the edge of the doctor blade 35 is 85 mT, allowing the magnetic brush 40 passing through the gap 36 to have higher stiffness than a magnetic brush of the conventional developing device.

In the developing device 19 of the present embodiment, it is assumed that the developing sleeve 26 has an area in which a toner film fell off from the developing sleeve 26 after printing out an image with high density (see FIG. 7 (*c*)).

Figure 8A:
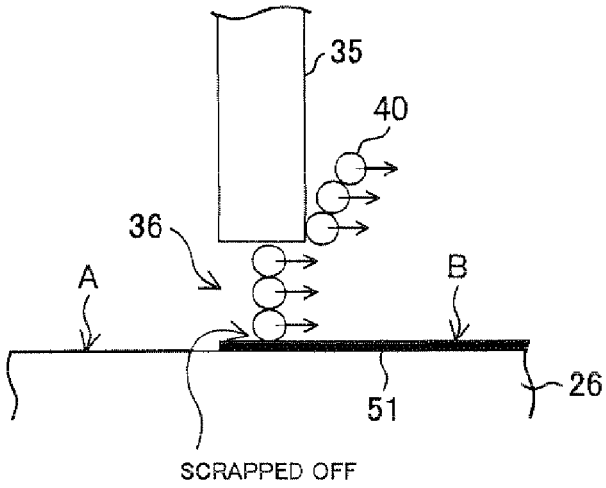
FIG. 8 (*a*) is an explanatory drawing illustrating a part of the developer adhered onto the outer surface of the developing sleeve is scraped off by a doctor blade in the developing device in accordance with an embodiment of this technology.
Figure 8B:
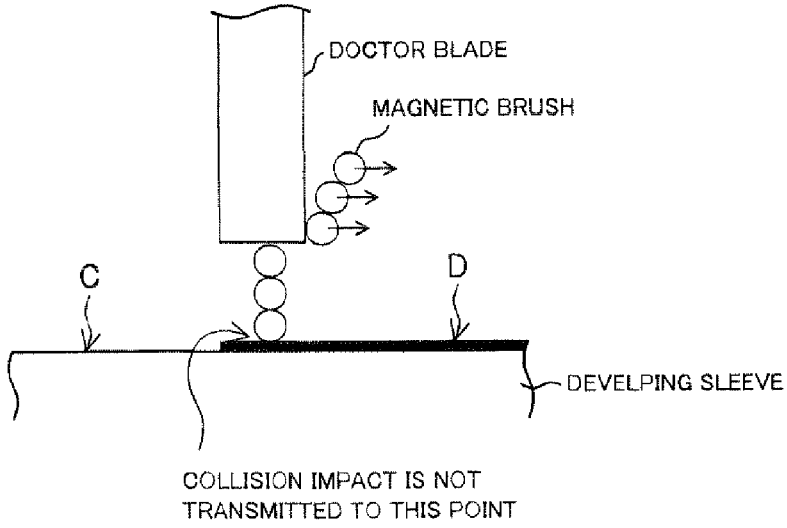
FIG. 8(b) PRIOR ART

However, in the developing device 19 of the present embodiment, as illustrated in FIG. 8 (*a*), after an area "A" in which a toner film fell off is produced, when a doctor blade 35 and a magnetic brush 40 adhered onto a toner film 51 in an area "B" collide with each other, there is a short time lag between (i) the timing of collision and (ii) the timing when the magnetic brush 40 is broken by the collision because the magnetic brush 40 has higher stiffness than a magnetic brush of the conventional developing device. During this time lag, the impact generated by the collision between the magnetic brush 40 and the doctor blade 35 is transmitted to the contact point between the magnetic brush 40 and the toner film 51. This transmitted impact breaks a part of the toner film 51 into toner powder. The toner powder is carried from the area "B" to the area "A" by the rotation of the developing sleeve 26. As a result, a new toner film is created in the area "A". As this process illustrated in FIG. 8 continues, a toner film is recreated entirely on the outer surface of the developing sleeve 26. Therefore, even if there is temporarily a part in which a toner film fell off from the outer surface of the developing sleeve 26 after printing an image with high density, the developing device 19 of the present embodiment can immediately recreate a new toner film on the part. This allows a toner film to be formed substantially constantly on the entire outer surface of the developing sleeve 26 so as not to maintain the situations illustrated in FIG. 7 (*c*) and FIG. 7 (*d*). As a result, it is possible to prevent the generation of the development memory and the degradation of the printed image.

On the other hand, according to the conventional developing device, as illustrated in FIG. 8 (*b*), when a doctor blade and a magnetic brush adhered onto a toner film in an area "D" are collided with each other by the rotation of the developing sleeve, the magnetic brush is immediately broken by the collision impact because the magnetic brush is less stiff than that of the present embodiment and the collision impact is absorbed by the break of the magnetic brush. Accordingly, the collision impact generated between the magnetic brush and the doctor blade is less apt to be transmitted to the contact part between the magnetic brush and the toner film. This rarely causes a break of the toner film. Accordingly, the toner in the area "D" is never transmitted to an area "C" which does not have a toner film. Therefore, unlike the developing device 19 of the present embodiment, once the area "C" which has no toner film is created on the developing sleeve by printing an image with high density, the conventional developing device is not able to recreate a new toner film at the area "C" immediately and tends to have the situations illustrated in FIG. 7 (*c*) and FIG. 7 (*d*) continuously. This causes the development memory, which leads to the image degradation.

Also, with the developing device 19 of the present embodiment, the magnetic flux density of the gap 36 is set to be 85 mT. However, it is not limited to this value. The following examples of experiments show that it is possible to suppress the development memory when the magnetic flux density of the gap 36 ranges from 70 mT to 150 mT. The magnetic flux density of the gap 36 is required to be 70 mT or more in order to increase the stiffness of the magnetic brush 40 to suppress the development memory. On the other hand, the magnetic flux density of the gap 36 is required to be 150 mT or less for the reason as follows. If the magnetic flux density of the gap 36 exceeds 150 mT, the magnetic brush 40 becomes too stiff, and the absorbability between the magnetic brush 40 and the toner film 51 in FIG. 8 (*a*) becomes too strong. Consequently, the toner film 51 in the area "B" becomes hard to be broken by the magnetic brush 40. This makes it more difficult to recreate a new toner film in the area "A", resulting in that the development memory tends to be generated.

Further, the outer surface of the developing sleeve 26 has a plurality of grooves. As illustrated in FIG. 5, the grooves are designed to have a rectangular shape (substantially rectangular) in a cross section of the developing sleeve 26 when it is cut by a plane perpendicular to the axis of the developing sleeve 26. This shape helps to prevent accumulating developer inside the grooves. When the toner film 51 in the area "B" is scraped due to the high stiffness of the magnetic brush 40 and toner powder is produced, the toner powder is carried easily from the area "B" with a toner film 51 to the area "A" with no toner film because toner powder is less likely to be accumulated in the grooves between the area "A" and the area "B". This allows suppressing the generation of the development memory.

Further, according to the later-mentioned experiment examples, it is preferable that a pitch between grooves provided on the outer surface of the developing sleeve 26 ranges from 1.25 mm to 4.00 mm. The following explains the reasons why the pitch should range from 1.25 mm to 4.00 mm. In a case where the number of grooves provided on the outer surface of the developing sleeve 26 is too large, there is a possibility that when the toner film 51 in the area "B" is scraped due to the high stiffness of the magnetic brush 40 and toner powder is produced, a part of the toner powder is not smoothly carried from the area "B" to the area "A" due to the too large number of the grooves. When the pitch between grooves is 1.25 mm or more, the number of grooves is considered not so large as to negatively affect the carriage of the toner powder. This allows smooth carriage of the toner powder from the area "B" to the area "A", resulting in that the generation of the development memory is prevented effectively. When the pitch between grooves exceeds 4.00 mm, the number of grooves becomes too small, which makes it difficult to achieve the original purpose for providing grooves on the outer surface of the developing sleeve 26 (i.e. improving the magnetic attraction for developer stored inside the developer tank 27 to suppress generation of an image with low density). In the present embodiment, the pitch between grooves means the distance between a side wall of a groove S located at the downstream with regard to the direction T and a side wall of a groove Q located at the downstream with regard to the direction T as illustrated in FIG. 5.

Further, according to the later-mentioned experiment examples, it is preferable that the width of each groove on the developing sleeve 26 ranges from 0.20 mm to 0.35 mm. The following explains the reason why the width of the groove should range from 0.20 mm to 0.35 mm. When the width of the groove on the developing sleeve 26 is less than 0.2 mm, the groove is too small, which makes it difficult to achieve the original purpose for providing the groove on the developing sleeve 26 (i.e. improving the magnetic attraction for developer stored inside the developer tank 27 to suppress generation of an image with low density), and makes it difficult to obtain stable image density under high temperature and high humidity conditions in particular. On the other hand, when the width of the groove on the developing sleeve 26 exceeds 0.35 mm, unevenness in image density occurs. In the present embodiment, the width of the groove means the length of the bottom plane of the groove in the direction T as illustrated in FIG. 5.

Further, according to the later-mentioned experiment examples, it is preferable that the depth of the groove on the developing sleeve 26 ranges from 0.08 mm to 5.00 mm. The following explains the reason why the depth of the groove should range from 0.08 mm to 5.00 mm. When the depth of the groove is less than 0.08 mm, the groove is too small, which makes it difficult to achieve the original purpose for providing the groove on the developing sleeve 26 (i.e. improving the magnetic attraction for developer stored inside the developer tank 27 to suppress generation of an image with low density). When the depth of the groove exceeds 5 mm, developer is likely to be accumulated inside the groove in long-term usage, which causes the degradation of a printed image. In the present embodiment, the depth of the groove means the distance between the outer surface of the developing sleeve 26 and the bottom of the groove in the diameter direction.

In the developing device 19 of the present embodiment, as illustrated in FIG. 4, the magnet S1 for generating magnetism at the gap 36 is provided between the rotation axis of the developing sleeve 26 and the doctor blade 35. In other words, the magnet S1 is located closer to the gap 36 inside the developing sleeve 26. This allows the magnetism to work effectively at the gap 36, making it easy to set the magnetic flux density at the gap 36 to range from 70 mT to 150 mT.

Further, in the present embodiment, the doctor blade 35 may be made of any one of magnetic metal, non-magnetic metal, and plastic. If the doctor blade 35 is made of magnetic metal, the gap 36 is sandwiched between the magnet S1 and the magnetic material. Consequently, the synergetic effect of the magnet S1 and the magnetic material works, which makes it more easy to set the magnetic flux density at the gap 36 to be 70 mT or more. Examples of the magnetic material include: stainless JIS 400's (SUS 410, SUS 420, and SUS 430), and stainless JIS 329's (SUS 329).

Further, in the developing device 19 of the present embodiment, when a volume average particle size of carrier in developer is less than 20 μm, the magnetic brush 40 illustrated in FIG. 8 (*a*) becomes less stiff and less apt to scrape off the toner film 51.

On the other hand, when the volume average particle size of carrier in developer exceeds 60 μm, the specific surface area of carrier becomes small. This is likely to causes fogs and undesirable density of an image because the developer has narrower allowable range of toner density. Namely, when the volume average particle size of carrier becomes too large, the specific surface area of carrier becomes small. As a result, the coating ratio of toner particles to carrier increases, which drops the amount of toner attracted by the developing roller 24 (There is no space for new toner particles on the surface of the carrier particles entirely covered by toner particles).

Therefore, in the developing device 19 of the present embodiment, it is preferable that the volume average particle size of carrier ranges from 20 μm to 60 μm in order to suppress fogs, undesirable density in image, and the generation of the development memory.

Further, in the developing sleeve 19 of the present embodiment, it is preferable to use the carrier obtained by covering ferrite-based core particles with thermosetting resin. The breakage of carrier can be prevented by using the carrier covered by the thermosetting resin since the resin covering the carrier is hard to be peeled off even when the carrier in the magnetic blade 40 continuously scrapes off the toner film 51 as illustrated in FIG. 8 (*a*).

Further, in the developing sleeve 19 of the present embodiment, it is preferable to use the carrier whose saturated magnetization ranges from 30 emu/g to 70 emu/g. This makes the magnetic brush 40 as illustrated in FIG. 8 (*a*) stiff enough to scrape off the toner film 51, which allows preventing the generation of the development memory further.

Recently, small particle toner whose volume average particle size ranges from 4 μm to 7 μm has been widely used in order to improve the quality of a printed image. As the particle size of toner gets smaller, the phenomenon illustrated in FIG. 7 (*a*) through FIG. 7 (*d*), i.e. the development memory is more likely to occur. Thus, the developing device 19 of the present embodiment is preferably applicable to the image forming apparatus using toner whose volume average particle size ranges from 4 μm to 7 μm.

EXPERIMENT EXAMPLES

The inventors carried out printing tests (comparison tests) by using image forming apparatuses of Examples 1 though 19 and image forming apparatuses of Comparative Examples 1 thorough 13. The following explains Examples 1 through 19, Comparative Examples 1 through 13, and the results of the printing tests.

Example 1

Example 1 was the image forming apparatus 50 of the present embodiment illustrated in FIG. 2 through FIG. 5. In the black image forming unit 1, a photosensitive drum 16 of 60 mm in diameter and a developing roller 24 of 40 mm in diameter were used. In each of the image forming units 2 through 4 other than the black image forming unit 1, a photosensitive drum of 30 mm in diameter and a developing roller 24 of 20 mm in diameter were used. The process velocity of each of the image forming units 1 through 4 was set to be 175 mm/sec., and the peripheral velocity of the developing roller was set to be 280 mm/sec. Further, in the image forming apparatus 50 of the present embodiment, each image forming unit had a developing sleeve having on its outer surface a plurality of grooves each being 2.0 mm in pitch, 0.25 mm in width, and 1.0 mm in depth.

Further, each of the image forming units 1 through 4 was adjusted so that the amount of toner deposited on a sheet of paper which was provided from each image forming unit was 0.5 mg/cm$^2$. There was conducted a printing test to print a chart in which a halftone image whose image density ID ranged from 0.5 to 0.8 was printed as a background, and a solid image part (1 cm×1 cm) colored by respective colored toners whose image density IDs were 1.4 or more were located at the head part of the chart in the paper feeding direction.

Note that the image density ID is an image density measured by using a Macbeth densitometer and is represented by the following equation.

$$ID=10\cdot\log(Pi/Po)$$

where Pi is intensity of light incident to an image and Po is intensity of light reflected from an image.

As a result of the printing test to print the chart by the image forming apparatus 50 of Example 1, the printed chart was clear. As shown in Table 1, unevenness in density due to the development memory, abnormal density due to insufficient attraction of developer, image degradation caused by other reasons, and clogged grooves of a developing sleeve were not detected.

Examples 2 through 19

Image forming apparatuses 50 of Examples 2 through 19 were basically the same as the image forming apparatus of Example 1 except that only the pitch between grooves on the outer surface of the developing sleeve, the width of the groove, the depth of the groove, and the magnetic flux density between the developing sleeve and the doctor blade were changed to the values mentioned in Table 1. The printing tests were carried out with respect to the image forming apparatuses of Examples 2 though 19 under the same testing condition as that of the Example 1. As a result, the obtained charts were printed clearly as mentioned in Table 1. The unevenness in density due to the development memory, the abnormal

TABLE 1

| | Grooves on the developing sleeve | | | Magnetic | Evaluation Result | | | |
|---|---|---|---|---|---|---|---|---|
| | width (mm) | pitch (mm) | depth (mm) | flux density * | Development Memory | Insufficient attraction of developer | Other image degradation | Remarks |
| EX. 1 | 0.2 | 2 | 1 | 85 | N/A | N/A | N/A | |
| EX. 2 | 0.25 | 2 | 1 | 85 | N/A | N/A | N/A | |
| EX. 3 | 0.3 | 2 | 1 | 85 | N/A | N/A | N/A | |
| EX. 4 | 0.35 | 2 | 1 | 85 | N/A | N/A | N/A | |
| EX. 5 | 0.25 | 1.25 | 1 | 85 | N/A | N/A | N/A | |
| EX. 6 | 0.25 | 1.5 | 1 | 85 | N/A | N/A | N/A | |
| EX. 7 | 0.25 | 2 | 1 | 85 | N/A | N/A | N/A | |
| EX. 8 | 0.25 | 3 | 1 | 85 | N/A | N/A | N/A | |
| EX. 9 | 0.25 | 4 | 1 | 85 | N/A | N/A | N/A | |
| EX. 10 | 0.25 | 2 | 0.08 | 85 | N/A | N/A | N/A | |
| EX. 11 | 0.25 | 2 | 0.16 | 85 | N/A | N/A | N/A | |
| EX. 12 | 0.25 | 2 | 1 | 85 | N/A | N/A | N/A | |
| EX. 13 | 0.25 | 2 | 2 | 85 | N/A | N/A | N/A | |
| EX. 14 | 0.25 | 2 | 5 | 85 | N/A | N/A | N/A | |
| EX. 15 | 0.25 | 2 | 1 | 70 | N/A | N/A | N/A | |
| EX. 16 | 0.25 | 2 | 1 | 85 | N/A | N/A | N/A | |
| EX. 17 | 0.25 | 2 | 1 | 100 | N/A | N/A | N/A | |
| EX. 18 | 0.25 | 2 | 1 | 120 | N/A | N/A | N/A | |
| EX. 19 | 0.25 | 2 | 1 | 150 | N/A | N/A | N/A | |

* Magnetic flux density between developing sleeve and doctor blade (mT)

TABLE 2

| | Grooves on the developing sleeve | | | Magnetic | Evaluation Result | | | |
|---|---|---|---|---|---|---|---|---|
| | width (mm) | pitch (mm) | depth (mm) | flux density * | Development Memory | Insufficient attraction of developer | Other Image degradations | Remarks |
| Com. EX. 1 | 0.1 | 2 | 1 | 85 | N/A | detected | N/A | |
| Com. EX. 2 | 0.15 | 2 | 1 | 85 | N/A | detected | N/A | |
| Com. EX. 3 | 0.4 | 2 | 1 | 85 | N/A | N/A | detected | |
| Com. EX. 4 | 0.45 | 2 | 1 | 85 | N/A | N/A | detected | |
| Com. EX. 5 | 0.25 | 5 | 1 | 85 | N/A | detected | N/A | |
| Com. EX. 6 | 0.25 | 6 | 1 | 85 | N/A | detected | N/A | |
| Com. EX. 7 | 0.25 | 2 | 0.02 | 85 | N/A | detected | N/A | |
| Com. EX. 8 | 0.25 | 2 | 0.05 | 85 | N/A | detected | N/A | |
| Com. EX. 9 | 0.25 | 2 | 7 | 85 | N/A | N/A | N/A | grooves were clogged |
| Com. EX. 10 | 0.25 | 2 | 10 | 85 | N/A | N/A | N/A | grooves were clogged |
| Com. EX. 11 | 0.25 | 2 | 1 | 50 | detected | N/A | N/A | |
| Com. EX. 12 | 0.25 | 2 | 1 | 60 | detected | N/A | N/A | |
| Com. EX. 13 | 0.25 | 2 | 1 | 180 | detected | N/A | N/A | |

* Magnetic flux density between developing sleeve and doctor blade (mT)

density due to insufficient attraction of developer, the image degradation caused by other reasons, and clogged grooves of the developing sleeve were not detected.

Comparative Examples 1 through 13

Image forming apparatuses of Comparative Examples through 13 were basically the same as the image forming apparatus of Example 1 except that only the pitch between grooves on the outer surface of the developing sleeve, the width of the groove, the depth of the groove, and the magnetic flux density between the developing sleeve and the doctor blade were changed to the values mentioned in Table 2. The printing tests were carried out in the image forming apparatuses of Comparative Examples 1 though 13 under the same testing condition as that of Example 1. As a result, as shown in Table 2, one of unevenness in density due to the development memory, abnormal density due to insufficient attraction of developer, image degradation caused by other reasons, and clogged grooves of the developing sleeve was detected.

Considering the test results of Examples 1 through 19 and Comparative Examples 1 through 13, it is clear that when the magnetic flux density ranged from 70 mT to 150 mT, no development memory was generated.

Also, considering the test results of Examples 1 through 19 and Comparative Examples 7 through 10, insufficient attraction of developer was detected when the depth of the groove on the outer surface of the developing sleeve was less than 0.08 mm, and the clogging of developer occurred in the groove on the outer surface of the developing sleeve when the depth of the groove exceeded 5 mm.

Further, considering the test results of Examples 1 through 19 and Comparative Examples 1 through 4, insufficient attraction of developer was detected when the width of the groove was less than 0.2 mm, and image degradation caused by a reason other than the development memory and the insufficient attraction of developer was detected when the width of the groove exceeded 0.35 mm.

[Test Condition]

The following explains in detail the printing test condition under which Examples 1 though 19 and Comparative Examples 1 through 13 were carried out.

(a) Paper

Recycled A4 size paper (Recycle Pure: SHARP DOCUMENT SYSTEMS CORPORATION) was used for the printing tests.

(b) Toner

The following explains in detail the manufacturing method of the toner contained in the two-component developer which was used in the printing tests.

First, 100 parts by weight of binder resin, 5 parts by weight of a coloring agent, 2 parts by weight of a charge control agent, 3 parts by weight of a release agent were put in a Henschel mixer as raw materials, and were mixed for 10 minutes. Then, the obtained mixture was melted, kneaded, and dispersed by a kneading and dispersion machine (KNEADEX MOS 140-800 manufactured by MITSUI MINING COMPANY, LIMITED).

As a binder resin, polyester resin (glass-transition temperature is 60° C.; softening temperature is 120° C.), which was obtained by polycondensation of bisphenol A monomer, propylene oxide monomer, and terephthalic acid monomer was used. Also, it is possible to use trimellitic anhydride instead of terephthalic acid.

Further, as a coloring agent for black toner, carbon black (MA-1 manufactured by Mitsubishi Chemical Corporation) was used; C. I. pigment red 122 was used for magenta toner; C. I. pigment blue 15:3 was used for cyan toner; and C. I. pigment yellow 74 was used for yellow toner. Also, as a charge control agent, a salicylate zinc compound (BONTRON E84 manufactured by Orient Chemical Industries, Ltd.) was used. As a release agent, a microcrystalline wax (HNP-9 manufactured by NIPPON SEIRO CO., LTD.) was used.

The mixture obtained by the melting, kneading and dispersing process was roughly pulverized by a cutting mill, and then was finely pulverized by a jet pulverizer (IDS-2 manufactured by Nippon Pneumatic Mfg. Co., Ltd.). The finely pulverized mixture was classified by a wind classifier (MP-250 manufactured by Nippon Pneumatic Mfg. Co., Ltd.). As a result, color resin particles whose volume average particle size was 6.5 μm were obtained. The volume average particle size was measured by a Coulter Multisizer 2 (manufactured by Beckman Coulter K.K.).

Further, 1.5 parts by weight of hydrophobic silica fine particles of approximately 12 nm in average primary particle size that were surface-treated with hexamethyldisilazane (BET specific surface area was approximately 140 $m^2/g$) and 1.0 parts by weight of hydrophobic silica fine particles of approximately 40 nm in average primary particle size that were surface-treated in the same way (BET specific surface area was approximately 50 $m^2/g$) were added to 100 parts by weight of the obtained color resin particles, and the resultant was mixed by Henschel mixer for two minutes to create negatively charged toner.

(c) Carrier

The following explains in detail the manufacturing method of the carrier contained in the two-component developer which was used in the printing tests.

First, ferrite powder was measured and was mixed by a ball mill. The mixture was calcinated by a rotary kiln at 900° C. The calcinated ferrite powder was finely pulverized by a wet pulverizer to obtain ferrite fine powder of 2 μm or less in average particle size with use of steal balls as pulverizing media. The obtained ferrite fine powder was granulated in a spray dry method to be fine powder of 100 μm to 200 μm in particle size. The granulated substance was sintered at 1300° C., and was crushed by a crusher to obtain ferrite particles of approximately 35 μm in volume average particle size. The ferrite particles were used as core particles of the carrier.

A coating liquid for coating the core particles was obtained by dissolving or dispersing silicone resin (TSR115 manufactured by Sin-Etsu Chemical Co., Ltd.) and potassium titanate powder (resistance adjusting agent) in toluene.

The ferrite particles were coated with the coating liquid by use of a spray coating machine, and was dried naturally to remove toluene. Thus was obtained carrier of 55 emu/g in saturated magnetization and 35 μm in volume average particle size, coated by 5 weight % of silicone resin (having 5 weight % of silicone resin in density). Note that the coating amount of silicone resin was calculated based on the amount of Fe derived from the ferrite particles and the amount of Si derived from the silicone resin, both of which amounts were measured by a fluorescent X-ray analyzer.

(d) Two-Component Developer

Two-component developers including respective color toners (black, cyan, magenta, and yellow) were produced by stirring and mixing 5 parts by weight of the respective color toners obtained in the above manner and 95 parts by weight of carrier with a Nauta mixer (VL-0 manufactured by Hosokawa Micron Corporation) for 20 minutes. The obtained two-component developers were used in the printing test.

(e) Photosensitive Drum

The photosensitive drums (layered photosensitive drum), which were used in Examples 1 through 19 and Comparative Examples 1 through 13, were manufactured through the following method.

First, 7 parts by weight of titanium oxide (TTO55A manufactured by ISHIHARA SANGYO KAISHA LTD.) and parts by weight of copolymer nylon (CM8000 manufactured by TORAY INDUSTRIES, INC) were added to a mixed solvent of 159 parts by weight of methyl alcohol and 106 parts by weight of 1,3-dioxolane. Additives in the mixed solvent were dispersed with a paint shaker for 8 hours to obtain a coating liquid for forming an underlying layer.

A cylindrical aluminum conductive base substance was soaked in a coating tank filled with the coating liquid for an underlying layer so that the liquid was applied on the surface of the cylindrical aluminum conductive base substance. Thereafter, the cylindrical aluminum conductive base substance was taken out from the tank, and was dried naturally to form an underlying layer of 1 μm in thickness on the peripheral surface of the cylindrical aluminum conductive base substance.

Next, 3 parts by weight of titanylphthalocyanine and 2 parts by weight of butyral resin (BL-1 manufactured by SEKISUI CHEMICAL CO., LTD) were added to 245 parts by weight of methylethylketone. The additives were dispersed with a paint shaker to obtain a coating liquid for forming a charge generating layer.

The coating liquid for forming a charge generating layer was applied on the surface of the underlying layer through the same soaking and applying method as that used when forming the underlying layer, and was dried naturally without wiping out the lower end. As a result, a charge generating layer of 0.4 μm in thickness was formed on the underlying layer of the cylindrical aluminum conductive base substance.

Next, 5 parts by weight of a charge transport compound (T405 manufactured by Takasago Chemical Corp.), 2.4 parts by weight of polycarbonate (J500 manufactured by Idemitsu Kosan Co., Ltd.), 1.6 parts by weight of polycarbonate (G400 manufactured by Idemitsu Kosan Co., Ltd.), 1.6 parts by weight of polycarbonate ($GHSO_3$ manufactured by Idemitsu Kosan Co., Ltd.), 2.4 parts by weight of polycarbonate (TS2020 manufactured by TEIJIN CHEMICALS LTD.), and 0.25 parts by weight of 2,6-bis-tert-butyl-4-methylphenol (Sumilizer BHT manufactured by Sumitomo Chemical Co., Ltd.) were added to and melted in 49 parts by weight of tetrahydrofuran. As a result, a coating liquid for forming a charge transport layer was obtained. The cylindrical aluminum conductive base substance was soaked in a coating tank filled with the coating liquid for forming a charge transport layer so that the liquid was applied on the surface of the charge generating layer through the soaking and applying method. Thereafter, the cylindrical aluminum conductive base substance was taken out from the tank and dried at 130° C. for 1 hour so that the charge transport layer was formed on the charge generating layer. Thus, an electro photoreceptor of 25 μm in thickness was obtained. Note that the thickness of the photosensitive drum was measured by a spectrophotometer (MCPD-1100 manufactured by OTSUKA ELECTRONICS CO., LTD).

[Details of Two-Component Developer]

The following explains in more detail the two-component developer used in the image forming apparatus 50 of the present embodiment.

The two-component developer of the present embodiment was made by mixing the toner and the carrier by a mixer such as a Nauta mixer. Normally, the ratio of toner to be mixed with carrier ranges from 3 to 15 parts by weight of toner with respect to 100 parts by weight of carrier. The toner and the carrier which are used in the present embodiment are explained below in this order.

The toner used in the present embodiments is made by adding an external additive to the surfaces of colored resin particles with an air flow mixer such as a Henschel mixer. The colored resin particles are made through publicly known methods such as a kneading and crushing method, or a polymerization. In the kneading and crushing method as an example, binder resin, a boron compound, a coloring agent, and other additives are mixed by a mixer such as Henschel mixer, a super mixer, a MECHANOMILL, and a Q-type mixer. The obtained material mixture was melted and kneaded by a kneader such as a biaxial kneader and a uniaxial kneader at approximately 70 to 180° C. The resultant thus kneaded was solidified by cooling, and then the solidified substance was pulverized by an air pulverizer such as a jet mill. If needed, size control such as classification may be conducted.

It is preferable that the volume average particle size of the colored resin particles (toner) ranges from 4 μm to 7 μm, which is measured by a Coulter Counter with 100 μm aperture manufactured by Coulter Corporation. When the volume average particle size is less than 4 μm, electric charging amount is unstable due to low flowability of the toner. When the volume average particle size exceeds 7 μm, dot reproducibility drops.

As a binder resin contained in the toner of the present embodiment, publicly known styrene acrylic resin and polyester resin may be used. Specifically, linear or nonlinear polyester resin is preferable because polyester resin is excellent in mechanical strength (less likely to produce fine powder), a fixing property (less likely to be detached from the paper after fixation), and anti-hot-offset property.

The polyester resin is obtained by polymerizing multivalent alcohol (bivalent or higher) and polybasic acid (bivalent or higher). Alternatively, if needed, the polyester resin is obtained by polymerizing a monomer composition including multivalent alcohol (tervalent or higher) or polybasic acid (tervalent or higher).

Examples of bivalent alcohol used for polymerization to produce polyester resin include: glycols such as ethylene glycol, diethylene glycol, triethylene glycol, 1,2-propylene glycol, 1,3-propylene glycol, 1,4-butanediol, and neopentyl glycol; diols such as 1,4-butendiol, 1,5-pentanediol, and 1,6-hexanediol; bisphenol A alkylene oxide adducts such as bisphenol A, hydrogenated bisphenol A, polyoxyethylenated bisphenol A, and polyoxypropylenated bisphenol A.

Examples of multivalent alcohol (tervalent or higher) include: sorbitol, 1,2,3,6-hexanetetrol, 1,4-sorbitan, pentaerythritol, dipentaerythritol, tripentaerythritol, saccharose, 1,2,4-butanetriol, 1,2,5-pentanetriol, glycerol, 2-methylpropantriol, 2-methyl-1,2,4-butanetriol, trimethylolmethane, trimethylolpropane, 1,3,5-trihydroxy methylbenzene, and the like.

Examples of bivalent polybasic acid include: maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, anhydrides of the forgoing acids, lower alkylester, alkenylsuccinic acids such as n-dodecynylsuccinic acid and n-dodecylsuccinic acid, and alkylsuccinic acids.

Examples of multivalent alcohol (tervalent or higher) include: 1,2,4-benzene tricarboxylic acid, 1,2,5-benzene tricarboxylic acid, 1,2,4-cyclohexane tricarboxylic acid, 2,5,7-naphthalene tricarboxylic acid, 1,2,4-naphthalene tricarboxylic acid, 1,2,5-hexane tricarboxylic acid, 1,3-dicarboxylic-2-methyl-2-methylene carboxy propane, tetra (methylenecarboxyl) metan, 1,2,7,8-octane tetracarboxylic acid, and anhydrides of the forgoing acids.

As the coloring agent which is used in the toner used in the image forming apparatus 50 of the present embodiment, generally-used and publicly known pigment and dye can be used. Specifically, examples of the coloring agent for black toner include: carbon black and magnetite.

Examples of the coloring agent for yellow toner include: acetoacetic acid arylamide monoazo yellow pigments such as C.I. pigment yellow 1, C.I. pigment yellow 3, C.I. pigment yellow 74, C.I. pigment yellow 97, C.I. and pigment yellow 98; acetoacetic acid arylamide disazo yellow pigments such as C.I. pigment yellow 12, C.I. pigment yellow 13, C.I. pigment yellow 14, and C.I. pigment yellow 17; condensed monoazo yellow pigments such as C.I. pigment yellow 93 and C.I. pigment yellow 155; other yellow pigments such as C.I. pigment yellow 180, C.I. pigment yellow 150, and C.I. pigment yellow 185; yellow dyes such as C.I. solvent yellow 19, C.I. solvent yellow 77, C.I. solvent yellow 79, and C.I. disperse yellow 164.

Examples of the coloring agent for magenta toner include: red or sanguine pigments such as C.I. pigment red 48, C.I. pigment red 49:1, C.I. pigment red 53:1, C.I. pigment red 57, C.I. pigment red 57:1, C.I. pigment red 81, C.I. pigment red 122, C.I. pigment red 5, C.I. pigment red 146, C.I. pigment red 184, C.I. pigment red 238, and C.I. pigment violet 19; reddish dyes such as C.I. solvent red 49, C.I. solvent red 52, C.I. solvent red 58, and C.I. solvent red 8.

Examples of the coloring agent for cyan toner include: bluish pigments and dyes made of copper phthalocyanine and its derivatives such as C.I. pigment blue 15:3 and C.I. pigment blue 15:4; green pigments such as C.I. pigment green 7 and C.I. pigment 36 (phthalocyanine green). The amount of the coloring agent to be added preferably ranges from 1 to 15 parts by weight, and more preferably ranges from 2 to 10 parts by weight, with respect to 100 parts by weight of binder resin.

For the toner used in the image forming apparatus 50 of the present embodiment, a publicly known charge control agent can be used. Specifically, examples of the charge control agent providing negative charge include: chromeazo complex dye, ironazo complex dye, cobaltazo complex dye, chromium/zinc/aluminum/boron complex with salicylic acid or its derivative, or salt compounds of salicylic acid or its derivative; chromium/zinc/aluminum/boron complex with naphthol acid or its derivative, or salt compounds of naphthol acid or its derivative; chromium/zinc/aluminum/boron complex with benzilic acid or its derivative, or salt compounds of benzilic acid or its derivative; long-chain alkyl carboxylate, and long-chain alkyl sulfonate.

Examples of a charge control agent providing positive charge include: nigrosine dye and its derivative, triphenylmethane derivative, quaternary ammonium salt derivative, quaternary phosphonium salt derivative, quaternary pyridinium salt derivative, guanidine salt derivative, and amidin salt derivative.

The amount of the charge control agent to be added preferably ranges from 0.1 to 20 parts by weight, more preferably ranges from 0.5 to 10 parts by weight, with respect to 100 parts by weight of binder resin.

Examples of the release agent, which is used with the toner for the image forming apparatus 50 of the present embodiment, include: synthetic waxes such as polypropylene and polyethylene; petroleum waxes and its denatured wax such as paraffin wax and its derivative and microcrystalline wax and its derivative; botanical waxes such as carnauba wax, rice wax, and candelilla wax. It is possible to increase the releasability of toner from a fixing roller and a fixing belt by adding these release agents to the toner, thereby preventing high-temperature and low-temperature offset in a fixing process.

A publicly known fluidizer may be added to the toner which is used for the image forming apparatus 50 of the present embodiment for the purpose of improving the flowability of the toner. Examples of the available fluidizers include hydrophobized inorganic particles obtained by surface-treating silica, titanium oxide, alumina, and the like of 0.007 to 0.03 μm in average particle size with use of a silane coupling agent, a titan coupling agent, or silicone oil.

It is preferable that the amount of the fluidizer to be added ranges from 0.3 to 3 parts by weight with respect to 100 parts by weight of toner. It is impossible to obtain the effect of the fluidizer, when the amount of the fluidizer to be added is less than 0.3 parts by weight. On the other hand, when the amount is not less than 3 parts by weight, flowability is likely to drop.

The carrier used in the image forming apparatus 50 may be magnetic particles from 20 to 60 μm in weight average particle size, obtained by coating the surface of magnetic core particles with a coating material. When the particle size of the carrier is less than 20 μm, an obtained image has white spots because the carrier is transmitted from the developing roller 24 to the photosensitive drum 16 in a developing process. On the other hand, when the particle diameter of the carrier exceeds 60 μm, an obtained image becomes rough due to drop in dot reproducibility. The volume average particle size of the carrier was measured by a laser diffraction particle size analyzer HELOS (made by Sympatec GmbH) in combination with a dry disperser RODOS (made by Sympatec GmbH) under dispersive pressure 3.0 bar.

It is preferable that the saturated magnetization of carrier ranges from 30 emu/g to 70 emu/g. When the saturated magnetization of carrier exceeds 70 emu/g, a magnetic brush becomes stiff, which makes it difficult to obtain an image true to an electrostatic latent image, and which makes it more likely that white spots appear. On the other hand, as the saturated magnetization of carrier is lower, the magnetic brush in contact with a photosensitive drum becomes softer. This allows obtaining an image true to an electrostatic latent image. However, when the saturated magnetization is less than 30 emu/g, the magnetic brush becomes too soft. This tends to cause the development memory because the magnetic brush fails to scrape off a toner film. Also, white spots are likely to appear due to the carrier adhesion on the surface of the photosensitive drum.

As core particles of carrier, publicly known magnetic particles can be used. It is preferable to use ferrite particles in terms of charging property and endurance. Publicly known ferrite particles can be used. Examples of the ferrite particles include: zinc ferrite, nickel ferrite, copper ferrite, nickel-zinc ferrite, manganese-magnesium ferrite, copper-magnesium ferrite, manganese-zinc ferrite, and manganese-copper-zinc ferrite. These ferrite particles are obtained by mixing materials, calcining and pulverizing them, and thereafter sintering them. Also, it is possible to alter the surface shape of ferrite particles by changing sintering temperature. Note that calcification may be carried out with a batch type machine, or a continuous type such as a rotary kiln.

As a coating agent, publicly known resin materials can be used. However, it is particularly preferable to use thermosetting resin in terms of resistance to abrasion. Publicly known thermosetting resins can be used. Examples of the thermosetting resins include: silicone varnishes such as TSR 115, TSR 114, TSR 102, TSR 103, YR 3061, TSR 110, TSR 116, TSR 117, TSR 108, TSR 109, TSR 180, TSR 181, TSR 187, TSR 144, and TSR 165 (made by Toshiba Corporation), KR 271, KR 272, KR 275, KR 280, KR 282, KR 267, KR 269, KR 211, and KR 212 (made by Shin-Etsu Chemical Co., Ltd.); alkyd denatured silicone varnishes such as TSR 184, and TSR 185

(made by Toshiba Corporation); epoxy denatured silicone varnishes such as TSR 194, and YS 54 (made by Toshiba Corporation); polyester denatured silicone varnishes such as TSR 187 (made by Toshiba Corporation); acrylic denatured silicone varnishes such as TSR 170, and TSR 171 (made by Toshiba Corporation); urethane denatured silicone varnishes such as TSR 175 (made by Toshiba Corporation); reactive silicone resins such as KA 1008, KBE 1003, KBC 1003, KBM 303, KBM 403, KBM 503, KBM 602, and KBM 603 (made by Shin-Etsu Chemical Co., Ltd.).

It is preferable that a resistance adjuster is added to the coating agent in order to control the resistance of carrier. Specifically, examples of the resistance adjuster include: silicon oxide, alumina, carbon black, graphite, zinc oxide, titan black, iron oxide, titanium oxide, tin oxide, potassium titanate, calcium titanate, aluminum borate, magnesium oxide, barium sulfate, and calcium oxide.

A publicly known method can be used in order to coat the carrier particles with a coating agent. Examples of the method include: a method in which the carrier particles are soaked in an organic solvent of the coating agent, a spray method in which the organic solvent of the coating agent is sprayed to the carrier particles, a fluid bed method in which the organic solvent of the coating agent is sprayed to the carrier particles floating in the fluidized air, a kneader coater method in which the carrier particles and the organic solvent of the coating agent are mixed with each other in a kneader coater, and then the resulting solvent is evaporated off. In this procedure, the resistance adjuster may be added to the organic solvent of the coating agent.

[Details of the Photosensitive Drum]

The following explains in detail the photosensitive drum used in the image forming apparatus 50 of the present embodiment.

Examples of the photosensitive drum 16 included in the image forming apparatus 50 of the present embodiment include an organic cylindrical photosensitive drum including a conductive base substance and a photosensitive layer, and an amorphous silicon photosensitive drum. Among them, the organic photosensitive drum is preferable in terms of manufacturing cost and safety. Organic photosensitive drums are classified into two types: a multi-layered type and a single-layered type. The multi-layered type is preferable since it is excellent in sensitivity and residual potential. The multi-layered photosensitive drum includes: a conductive base substance; a charge generating layer having a charge generating compound, layered on the base substance; and a charge transport layer having a charge transport compound, layered on the charge generating layer. It is more preferable to have an underlying layer between the conductive base substance and the charge generating layer.

As a conductive base substrate, for example, a cylindrical shaped aluminum, a cylindrical shaped plastic including conductive particles, and the like are available. Examples of the underlying layer include polyamide resin and copolymerized nylon resin in which an inorganic pigment such as zinc oxide and titanium oxide is dispersed with a disperser such as a ball mill and a dyno mill.

The charge generating layer is a charge generating substance which generates electrical charge by light radiation. Examples of the charge generating layer include polycarbonate resin, phenoxy resin, phenol resin, polyvinylbutyral resin, polyalylate resin, polyamide resin, and polyester resin, in each of which an inorganic pigment such as metal-free phthalocyanine pigment and titanyl-phthalocyanine pigment is dispersed with a disperser such as a ball mill and a dyno mill.

The charge transport layer provided on the charge generating layer is a charge transport substance which has a capability of receiving and transporting electrical charge which is generated by the charge generating substance. Examples of the charge transport layer include polycarbonate, copolymerized polycarbonate, and polyalylate, each of which includes electron-releasing substance or electron-accepting substance.

Examples of the electron-releasing substance include: poly-N-vinylcarbazole and its derivative, poly-γ-carbazolylethylglutamate and its derivative, pyrene-formaldehyde condensate and its derivative, polyvinylpyrene, polyvinylphenanthrene, oxazole derivative, oxadiazole derivative, imidazole derivative, 9-(p-diethylaminostyryl) anthracene, 1,1-bis(4-dibenzylaminophenyl) propane, styrylanthracene, styrylpyrazoline, pyrazoline derivative, phenylhydrazones, hydrazone derivative, triphenylamine compound, triphenylmetane compound, stilbene compound, and azine compound containing 3-methyl-2-benzothiazoline ring.

Examples of the electron-accepting substance include: fluorenone derivative, dibenzothiophene derivative, indenothiophene derivative, phenanthrenequinone derivative, indenopyridine derivative, thioxanthone derivative, benzo[c] cinnoline derivative, phenazineoxide derivative, tetracyanoethylene, tetracyanokinodimetane, bromanil, chloranil, and benzoquinone. It is preferable that 30 to 80 weight % of the electron-accepting substance is included in the charge transport layer.

Note that the value of the magnetic flux density indicated in this specification is an absolute value. The developing device and the image forming apparatus of the present embodiment are suitable for use in an electrophotographic multifunction printer, a copying machine, a printer, and a facsimile.

The inventors found that the generation of the development memory at the developing sleeve can be prevented by the developing device including: a developing roller including a rotating sleeve which rotates while holding two-component developer composed of toner and magnetic carrier on an outer surface having a plurality of grooves that extend in a direction parallel to an axis of the rotation, and a magnetic member, provided inside the rotating sleeve in such a manner as to be unrotatable, for attracting the two-component developer onto the outer surface of the rotating sleeve; and a blade, provided outside the rotating sleeve with a gap from the outer surface of the rotating sleeve for scraping off a part of the two-component developer, the magnetic member including a magnet for controlling a magnetic flux density in the gap to range from 70 mT to 150 mT.

Accordingly, this developing device yields an effect of suppressing degradation of a printed image which is caused by the generation of the development memory.

Also, it is preferable to arrange the developing device so that the pitch between adjacent grooves on the outer surface of the developing sleeve ranges from 1.25 mm to 4.00 mm. With the arrangement, it is possible to suppress the generation of the development memory more effectively and to prevent the deterioration in performance of the rotating sleeve to attract (effect of scooping) two-component developer.

Further, it is preferable to arrange the developing device so that a width of each of the grooves ranges from 0.20 mm to 0.35 mm. With the arrangement, it is possible to prevent the deterioration in performance of the rotating sleeve to attract (effect of scooping) two-component developer, and to suppress unevenness in density of an image that is finally obtained.

Further, it is preferable to arrange the developing device so that the depth of each of the grooves ranges from 0.08 mm to 5 mm. With the arrangement, it is possible to prevent the deterioration in performance of the rotating sleeve to attract (effect of scooping) two-component developer and to prevent the degradation of an image quality caused by the accumulation of two-component developer in the grooves in long term usage.

Further, it is preferable to arrange the developing device so that each of the grooves has a rectangular shape in a cross section of the rotating sleeve when the rotating sleeve is cut by a plane perpendicular to the axis. With the arrangement, it is possible to further prevent the generation of the development memory.

Further, it is preferable to arrange the developing device so that the magnet is provided between the axis and the blade. With the arrangement, the magnet is provided inside of the rotating sleeve so as to be in a position close to the gap. Consequently, it is possible to cause magnetism from the magnet to effectively work on the gap, and to set the magnetic flux density of the gap to range from 70 mT to 150 mT.

Further, it is preferable to arrange the developing device so that the blade is made of a magnetic material. With the arrangement, the gap is sandwiched by the magnet and the magnetic material. Consequently, it is possible to set the magnetic flux density of the gap to be 70 mT or more due to the synergetic effect between the magnet and the magnetic material.

Recently, toner of small particle size, whose volume average particle size ranges from 4 μm to 7 μm, is frequently used for improving the image quality of a printed image. As more amount of toner of small particle size is used, the generation of the development memory is remarkably increased in the developing sleeve. Therefore, the developing device capable of suppressing the development memory is suitable for the image forming process using the toner with the volume average particle size ranging from 4 μm to 7 μm.

Further, it is preferable to arrange the developing device so that the volume average particle size of the magnetic carrier ranges from 20 μm to 60 μm. With the arrangement, it is possible to prevent the development memory far more effectively.

Further, it is preferable to arrange the developing device so that the magnetic carrier is obtained by coating ferrite based core particles with thermosetting resin. With the arrangement, it is possible to prevent the breakage of the carrier since the resin coating the magnetic carrier is less likely to peel off.

Further, it is preferable to arrange the developing device so that saturated magnetization of the magnetic carrier ranges from 30 emu/g to 70 emu/g. With the arrangement, it is possible to further prevent the generation of the development memory.

The embodiments and concrete examples of implementation discussed in the foregoing detailed explanation serve solely to illustrate the technical details, which should not be narrowly interpreted within the limits of such embodiments and concrete examples, but rather may be applied in many variations within the spirit of this technology, provided such variations do not exceed the scope of the patent claims set forth below.

What is claimed is:

1. A developing device comprising:

a developing roller, including:

a rotating sleeve which rotates while holding two-component developer composed of toner and magnetic carrier on an outer surface having a plurality of grooves that extend in a direction parallel to an axis of the rotation, wherein a pitch between adjacent grooves on the outer surface of the rotating sleeve ranges from 1.25 mm to 4 mm, wherein a width of each groove ranges from 0.2 mm to 0.35 mm, and wherein a depth of each of the grooves ranges from 0.08 mm to 5.00 mm, and a magnetic member, provided inside the rotating sleeve in such a manner as to be unrotatable, for attracting the two-component developer onto the outer surface of the rotating sleeve; and a blade, provided outside the rotating sleeve with a gap from the outer surface of the rotating sleeve, for scraping off a part of the two-component developer, the magnetic member including a magnet for controlling a magnetic flux density in the gap to range from 85 mT to 150 mT.

2. The developing device as set forth in claim 1, wherein:

each of the grooves has a rectangular shape in a cross section of the rotating sleeve when the rotating sleeve is cut by a plane perpendicular to the axis.

3. The developing device as set forth in claim 1, wherein:

the magnet is provided between the axis and the blade.

4. The developing device as set forth in claim 3, wherein:

the blade is made of a magnetic material.

5. The developing device as set forth in claim 1, wherein:

a volume average particle size of the toner ranges from 4 μm to 7 μm.

6. The developing device as set forth in claim 1, wherein:

a volume average particle size of the magnetic carrier ranges from 20 μm to 60 μm.

7. The developing device as set forth in claim 1, wherein:

the magnetic carrier is obtained by coating ferrite-based core particles with thermosetting resin.

8. The developing device as set forth in claim 1, wherein:

saturated magnetization of the magnetic carrier ranges from 30 emu/g to 70 emu/g.

9. The developing device as set forth in claim 1, wherein the magnetic flux density in the gap ranges from 100 mT to 150 mT.

10. An image forming apparatus comprising a developing device including:

a developing roller that includes:

a rotating sleeve which rotates while holding two-component developer composed of toner and magnetic carrier on an outer surface having a plurality of grooves that extend in a direction parallel to an axis of the rotation, wherein a pitch between adjacent grooves on the outer surface of the rotating sleeve ranges from 1.25 mm to 4 mm, wherein a width of each groove ranges from 0.2 mm to 0.35 mm, and wherein a depth of each of the grooves ranges from 0.08 mm to 5.00 mm, and a magnetic member, provided inside the rotating sleeve in such a manner as to be unrotatable, for attracting the two-component developer onto the outer surface of the rotating sleeve; and a blade, provided outside the rotating sleeve with a gap from the outer surface of the rotating sleeve, for scraping off a part of the two-component developer, the magnetic member including a magnet for controlling the magnetic flux density in the gap to range from 85 mT to 150 mT.

11. The image forming apparatus as set forth in claim 10, wherein the magnetic flux density in the gap ranges from 100 mT to 150 mT.

* * * * *